United States Patent [19]

Fogg et al.

[11] Patent Number: 4,925,401

[45] Date of Patent: May 15, 1990

[54] ELECTRICAL CONNECTOR ASSEMBLY WITH STRAIN RELIEF

[75] Inventors: Michael W. Fogg, Harrisburg; Michael J. Scully, Steelton; Brian A. Wolfe, Jonestown, all of Pa.

[73] Assignee: AMP Incorporated, Harrisburg, Pa.

[21] Appl. No.: 355,947

[22] Filed: May 23, 1989

[51] Int. Cl.[5] ..... H01R 13/58

[52] U.S. Cl. ..... 439/465; 439/404

[58] Field of Search ..... 439/404, 405, 465–467, 439/470

[56] References Cited

U.S. PATENT DOCUMENTS

| | | | |
|---|---|---|---|
| 3,824,530 | 7/1974 | Roberts et al. . | |
| 4,005,921 | 2/1977 | Hadden et al. | 439/466 |
| 4,094,566 | 6/1978 | Dola et al. . | |
| 4,408,823 | 10/1983 | Huber | 439/465 |
| 4,412,714 | 11/1983 | Morningstar et al. . | |
| 4,596,432 | 6/1986 | Tighe, Jr. | 439/466 |

*Primary Examiner*—Gary F. Paumen

*Attorney, Agent, or Firm*—Gerald K. Kita

[57] ABSTRACT

An electrical connector assembly 1 for electrical conductors 6 and a strain relief for the conductors 6, corresponding conductors 6 project from opposite first and second sides 4 of an insulative housing block 2 of the connector assembly 1, conductive electrical terminals inside the housing block 2 connected to corresponding conductors 6, duplicate first and second strain relief clamps latch to each other and clamp therebetween corresponding conductors 6 to provide the strain relief, and each of the clamps comprises, a clamping surface 23 elongated along a corresponding one of the sides 3 of the housing block 2, a first arm 24 projecting from a first end 25 of the clamping surface 23, a projecting first pivot surface 26 on the arm 24 received in a recess 33 in a corresponding end of the housing block 2 for pivoting the clamping surface 23 toward and against corresponding conductors 6, a concave portion 28 of the clamping surface 23 adjacent the first arm 24, a convex portion 30 of the clamping surface 23 for deflecting corresponding conductors 6 into a concave portion 28 of a duplicate clamp 22, and a latch 31 intersected by the convex portion 30.

6 Claims, 6 Drawing Sheets

ELECTRICAL CONNECTOR ASSEMBLY WITH STRAIN RELIEF

Each of the discussed advantages, features and objectives of the disclosed invention exists independently and contributes to the use and importance of the invention.

FIELD OF THE INVENTION

The specification discloses an electrical connector for insulated conductors and a strain relief for the insulated conductors.

BACKGROUND OF THE INVENTION

U.S. Pat. No. 4,094,566 discloses a prior electrical connector assembly for electrical conductors and a strain relief for the conductors, wherein duplicate first and second strain relief clamps latch to each other and clamp therebetween corresponding conductors to provide the strain relief. In the prior connector assembly, the strain relief clamps pivot toward each other along a first axis, and hinged portions of the clamps pivot along a second axis parallel to the first axis to clamp the corresponding conductors.

U.S Pat. No. 3,824,530 discloses a connector assembly of a daisy chain configuration, wherein corresponding conductors extend continuously through a housing block and project from opposite sides of the housing block. A clamp gathers the wires that project from a rear of the connector. However, wires that project from opposite sides of the connector are not gathered together.

SUMMARY OF THE INVENTION

An objective of the invention is to provide strain relief clamps for gathering and clamping corresponding conductors extending from opposite sides of an insulative housing block of a connector assembly, and to assemble the clamps by pivoting the clamps into connection with each other, or by latching the clamps together and sliding them along the conductors until the clamps latch onto the housing block.

According to a feature of the invention, each strain relief clamp comprises a pivot that pivots against a corresponding end of a housing block along a first orthogonal axis to become oriented parallel to a side of the housing block. Each clamp pivots along a second orthogonal axis to clamp against corresponding conductors and to latch with a duplicate clamp.

According to a feature of the invention, each of the strain relief clamps comprises a clamping surface for clamping against corresponding conductors, a concave portion of the clamping surface, a convex portion of the clamping surface for deflecting corresponding conductors into a concave portion of a duplicate clamp, and a projecting cantilever finger with a protuberance for latching registration in an end of the housing block. The advantage is, that the concave portion spaces the clamping surface from the conductors to enable substantial pivoting of the clamp before engaging the conductors and resisting further pivoting.

According to a feature of the invention, each clamp and corresponding cantilever finger have inclined leading edges that slide along the conductors and the housing block until the fingers latch with the housing block. The advantage is that the clamps are assembled, first to each other to gather the corresponding conductors, and then are slid along the conductors to latch the cantilever finger to the housing. The cantilever finger is advantageously of the type disclosed in U.S. Pat. No. 4,412,714.

According to a feature of the invention, the strain relief clamps are bulged outwardly to avoid damage to the corresponding conductors of a daisy chain configuration where the corresponding conductors emerge from the housing block.

U.S. Pat. No. 4,278,314 discloses a connector with strain relief clamps that to clamp two rows of conductors between the clamps. The clamps according to the invention reorient corresponding conductors that project from opposite sides of an insulative housing block of the connector assembly, and gather together the corresponding conductors in two rows of conductors between the clamps.

These and other advantages, features and objectives of the invention are disclosed by way of example from the following detailed description and accompanying drawings.

DESCRIPTION OF THE DRAWINGS

With reference to FIG. 1 of the drawings, there is shown a connector assembly 1 comprising an insulative housing block 2 having a row of recessed, conductor receiving channels 3 extending continuously along corresponding sides 4 of the housing block 2 and along a bottom 5 of the housing block 2. Individual conductors 6 of a continuous, flat flexible cable 7 are exposed from an insulative sheath 8 of the cable 7 and are laid along corresponding channels 3. The cable 7 projects from each corresponding side 4, and has two portions 9 that extend parallel and against each other. The exposed portions of the conductors 6 extend from one side 4, along the bottom 5 and along an opposite side 4. The conductors 6 are continuous, through both portions 9.

Figure 1:
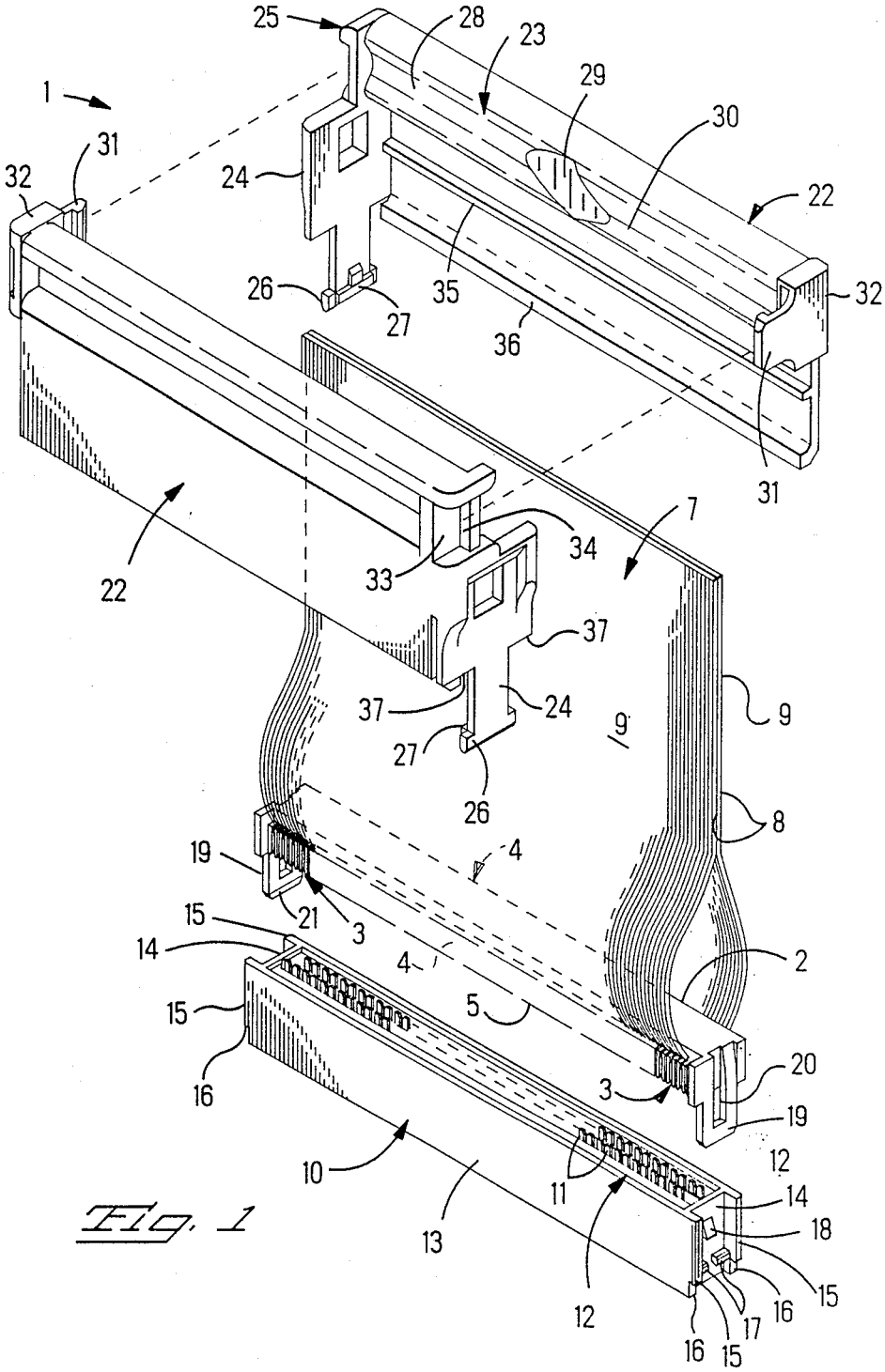
FIG. 1 is a fragmentary perspective view of a connector assembly with corresponding conductors and strain relief clamps.

An insulative housing 10 of the housing block 2 contains electrical contacts 11 in two rows 12. The contacts 11 of each row 12 align with the pitch spacing of alternate conductors 6. The contacts 11 of one row 12 are offset from contacts 11 of the other row 12 by the pitch spacing of adjacent conductors 6. Each conductor is aligned with and connected to a corresponding slot of a contact when the housing block 2 is assembled with its housing 10 to form the connector assembly 1.

The housing 10 has elongated external sides 13 and external end surfaces 14. Each end surface 14 is recessed from projecting, two elongate edge flanges 15 provided with undercuts 16 toward the front. Projecting outwardly from each end surface 14 are a pair of retention protuberances 17 toward the front of a rear, central retention protuberance 18.

A cantilever tab 19 projects outwardly front of each end of the housing block 2. Each tab 19 has a central, closed front, slot 20 extending in a direction from front to rear. A ramped inner surface 21 is on a front end of each tab 19.

The tab 19 is assembled slidably to the front and between the flanges 15. The ramp surface 21 of the tab 19 traverses over the central protuberance and the slot 20 receives the central protuberance and latches over and onto the central protuberance. The conductors 6 are forced into corresponding slots of the slotted contacts 11 and connect electrically thereby. The front end of the tab 19 is to the rear of the front protuberances.

Duplicate strain relief clamps 22 are disclosed in FIG. 1. The clamps latch to each other and clamp therebetween corresponding conductors 6 and the two cable portions 9 to provide strain relief. Each of the clamps 22 comprises a clamping surface 23 elongated along a corresponding one of the sides 13 of the housing 10, an arm 24 projecting from a first end 25 of the clamping surface 23 and extending axially forwardly, and extending laterally toward an opposite clamp 22.

A projecting, inward pivot surface 26 on the arm 24 is received in a corresponding end of the housing block 2 for pivoting the clamping surface 23 toward and against the cable 7 and corresponding conductors 6. The pivot surface 26 extends laterally outward to provide a T shaped end of the arm 24 that registers in front of the undercuts 16 and against the flanges 15. An inward flange 27 along the end of the arm 24 is of inverted T shape and registers in front of the front protuberances and also aligns the corresponding clamp 22 with the housing block 2 by extending between the front protuberences 17. The arm 24 is against the tab 19 and recessed between the flanges 15.

Figure 2:
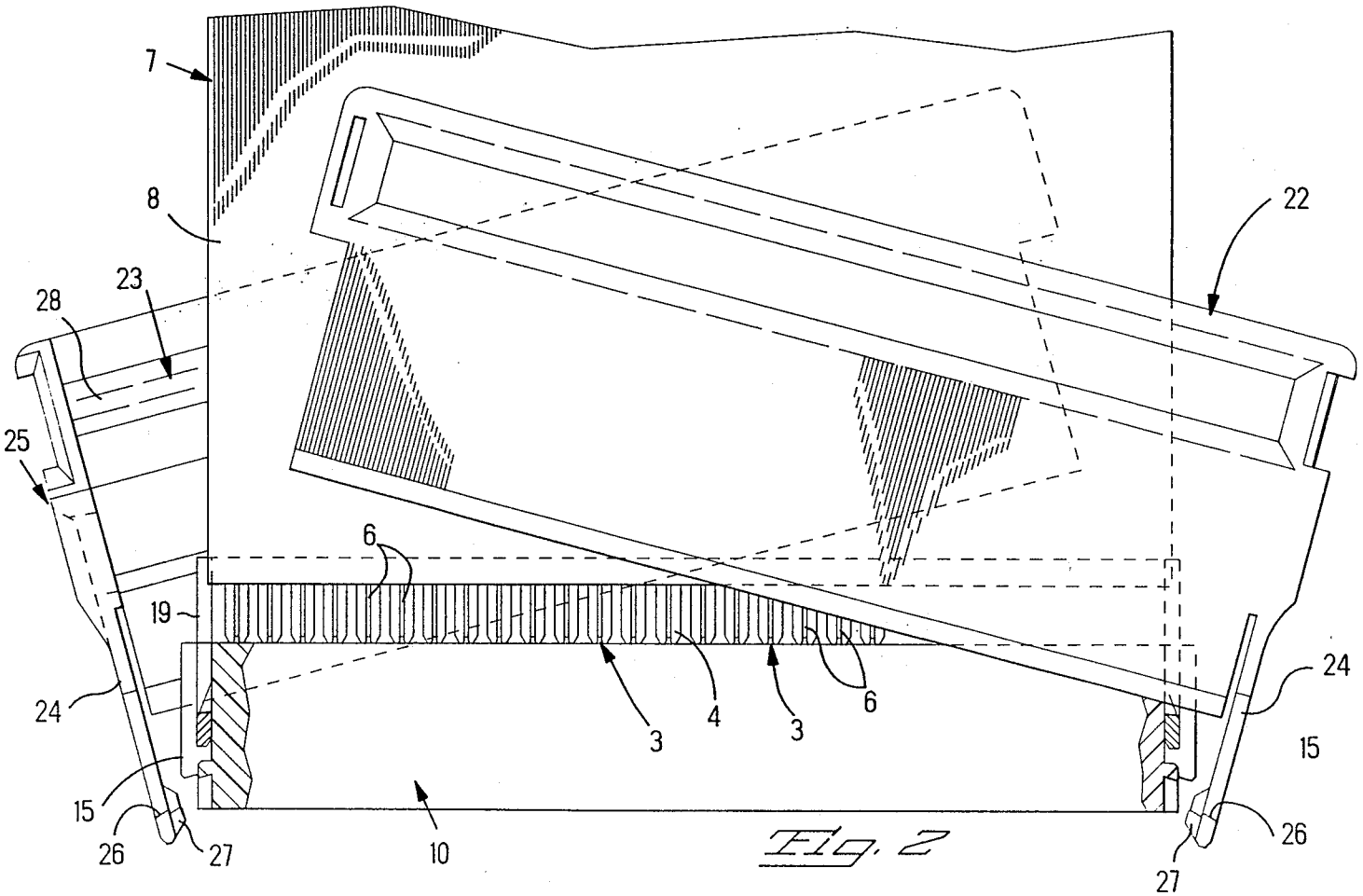
FIG. 2 is a fragmentary front elevation view of a connector assembly and strain relief clamps.
Figure 3:
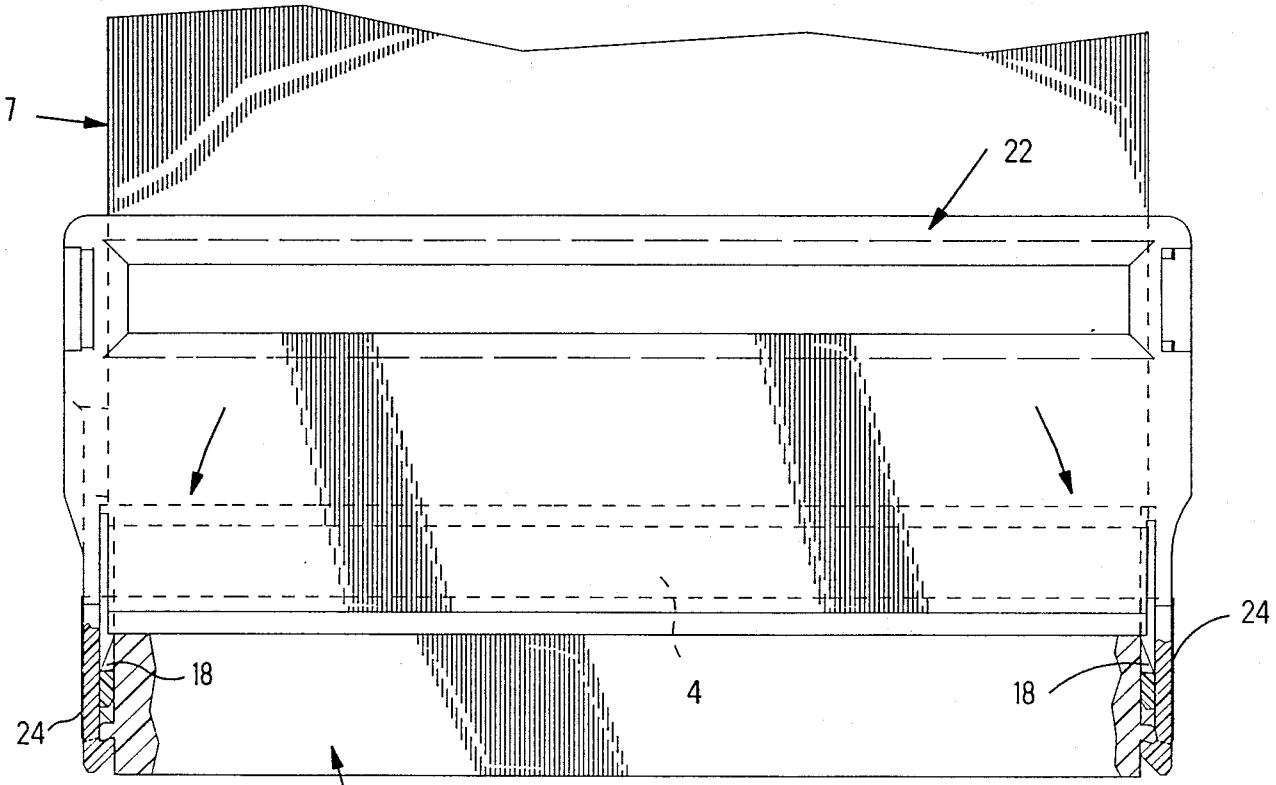
FIG. 3 is a fragmentary front elevation view of an of the connector assembly and strain relief clamps assembled together.
Figure 4:
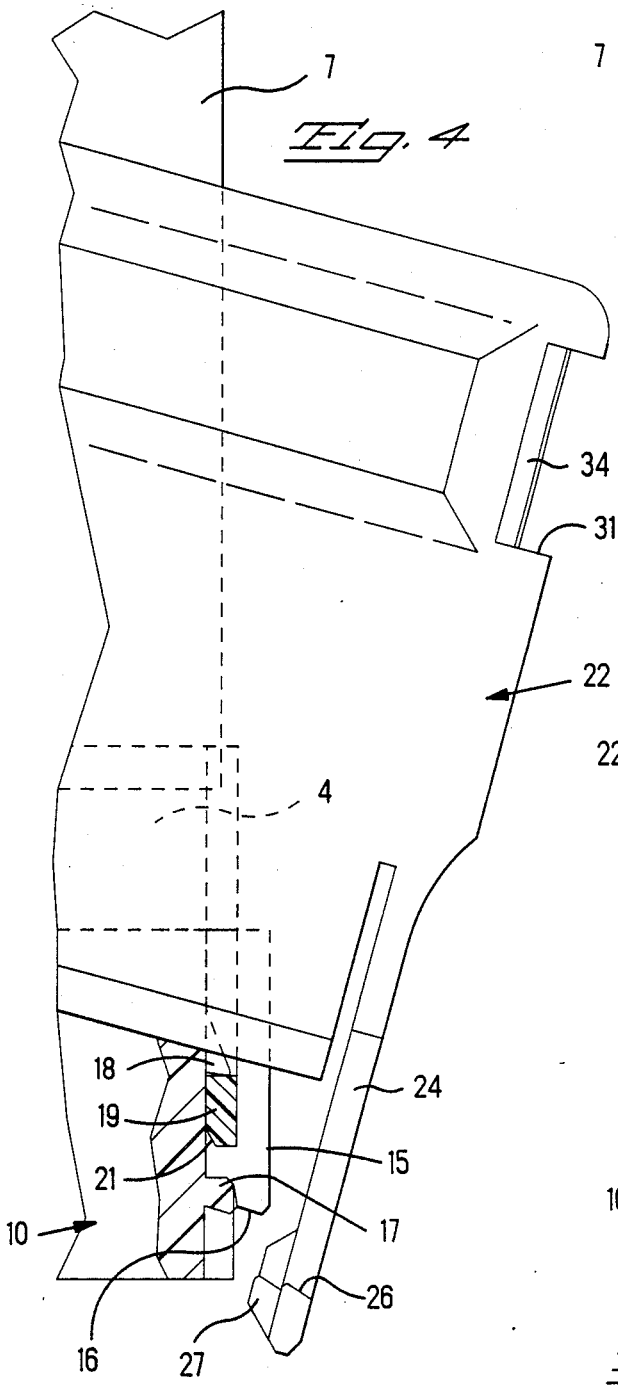
FIG. 4 is a fragmentary elevation view of a strain relief clamp during assembly with the connector assembly.
Figure 5:
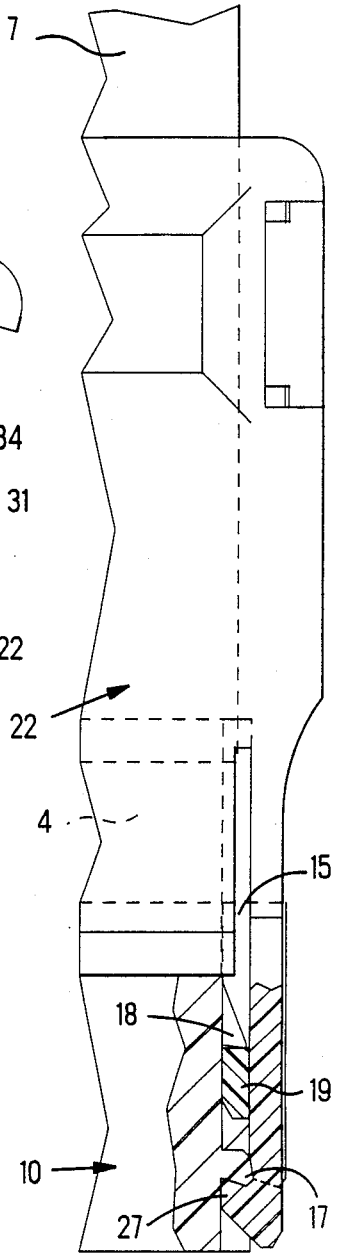
FIG. 5 is a fragmentary elevation view of a strain relief clamp assembled to the connector assembly.
Figure 6:
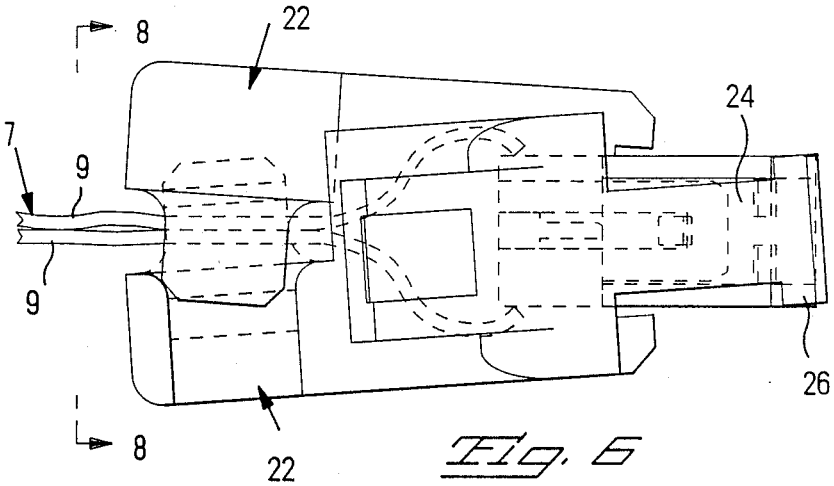
FIG. 6 is a side elevation view of strain relief clamps during assembly to the housing block.
Figure 7:
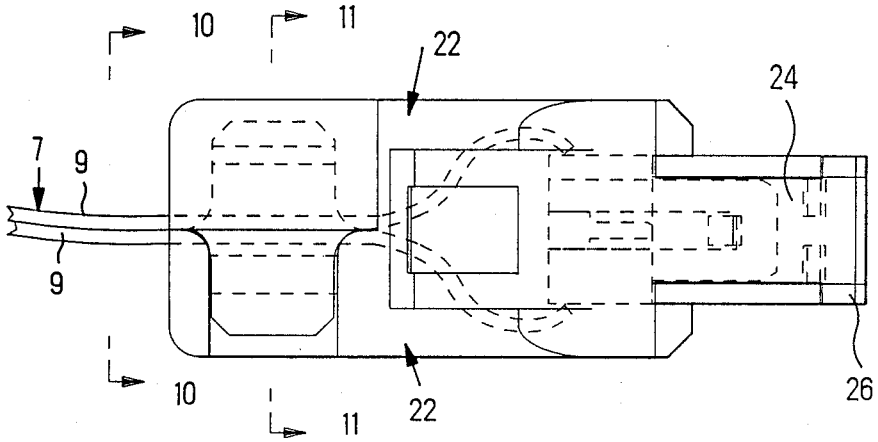
FIG. 7 is a view similar to FIG. 6 of the strain relief clamps assembled to the housing block.
Figure 8:
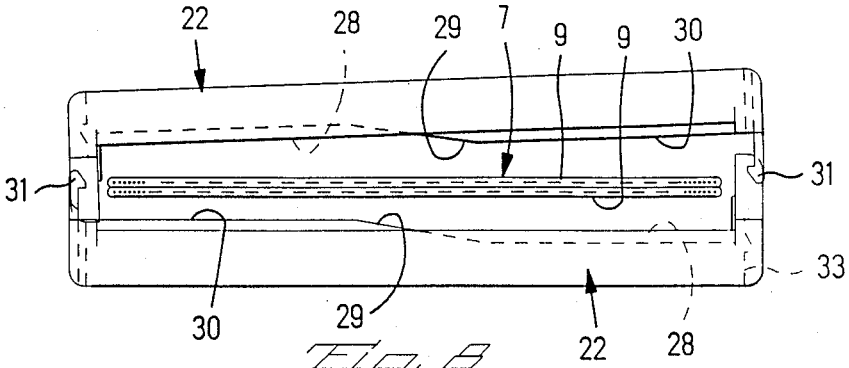
FIG. 8 is a section view taken along the line 8—8 of FIG. 6.

FIG. 2 illustrates assembly of the clamps to the cable 7 and the housing block 2. Part of the pivot surface 26 of a corresponding clamp 22 registers in a corresponding one of the undercuts 16, and allows lengthwise pivoting of the clamp 22, as shown in FIGS. 2 and 4, into parallel position with the housing block 2, as shown in FIGS. 3 and 5. Also, transverse pivoting of the corresponding clamp 22 is permitted, as shown in FIGS. 6 and 8, toward the other clamp 22.

Figure 9:
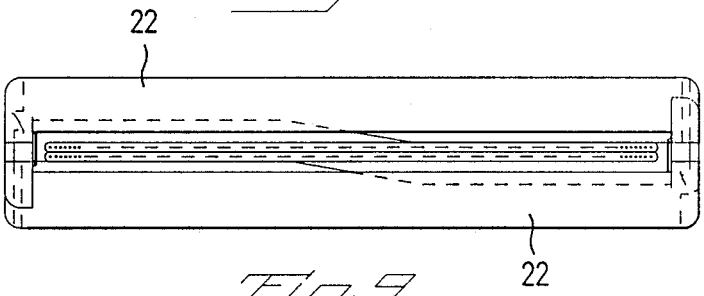
FIG. 9 is a view similar to FIG. 8 illustrating assembly of the strain relief clamps.
Figure 10:
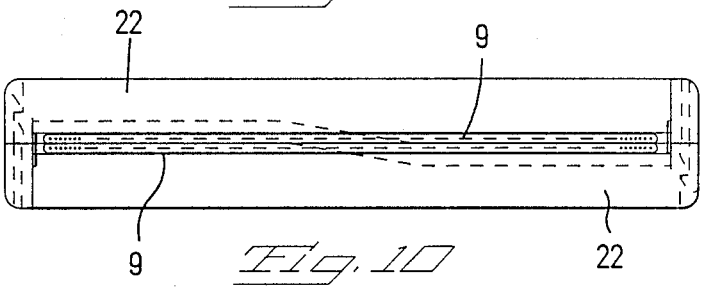
FIG. 10 is a section view taken along the line 10—10 of FIG. 7.
Figure 11:
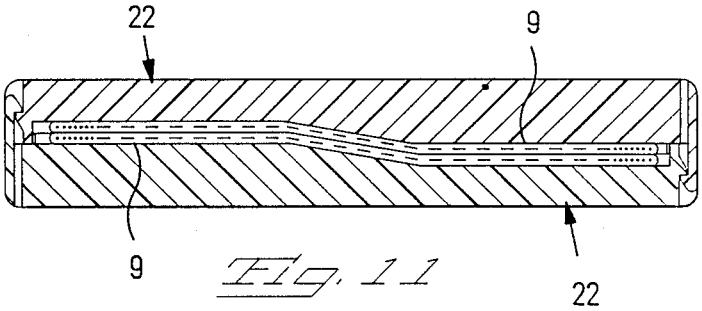
FIG. 11 is a section view taken along the line 11—11 of FIG. 7.

A concave portion 28 of the clamping surface 23 is adjacent the arm 24. The concave portion 28 is contiguous with a smooth inclined, blending surface 29, and further with a convex portion 30 of the clamping surface 23 for deflecting a corresponding portion of the cable 7 and corresponding conductors 6 into a concave portion 28 of a duplicate clamp 22, as shown in FIGS. 9 and 10. A transverse projecting latch 31 is at an outer end 32 of the convex portion 30 and of the clamp 22. The latch 31 projects toward an end of an opposite clamp 22 and registers in a recess 33 of the opposite clamp 22 in the same end 25 as the arm 24. The latch 31 registers against a shoulder 34 in the recess 33. The clamping surface 23 extends from the arm 24 to the latch 31, perpendicular to the arm 24 and parallel to the clamping surface 23.

The concave portion 28 allows an inner surface of the clamp 22 to pivot toward a corresponding portion 9 of the cable 7 and corresponding conductors 6 therein, without the cable 7 engaging the concave portion 28 and resisting the pivoting motion. As shown in FIG. 8, the top clamp 22 can pivot clockwise a substantial amount before the convex portion 30 engages the cable 7, and before the bottom clamp 22 pivots clockwise sufficiently to impinge the convex portion 30 thereof against the cable 7 and to deflect the cable 7 into the concave portion 28 of the top clamp 22. The pivot surface 26 of a corresponding clamp 22 registers in a corresponding one of the undercuts 16 and provides a latch means that allows pivoting of the clamp 22 on the housing block 2. When the clamps 22 latch together, the pivot surface 26 register fully in the undercuts 16 and latches therein. The inward flange 27 registers against and in front of the front protuberences 17. An internal first ridge 35 of the corresponding clamp 22 extends parallel to the clamping surface 23 and engages against the housing block 2. An internal second ridge 36 along an edge of a corresponding clamp 22 extends perpendicular to the first arm 24 and parallel to the clamping surface 23, and is engaged against the housing 10 of the housing block 2. The ridge and second ridge clamp on the housing 10 of the housing block 2, while the clamping surfaces engage the portions 9 of the cable 7. The clamp 22 is bulged outwardly between the ridges 35 and 36 to avoid the conductors 6 where they emerge from the housing block 2. Each portion 9 of the cable 7 is deflected during clamping into engagement against the other portion 9, and further deflected into two offset planes, FIG. 10, extending transversely across the length of the cable 7. Rear movement of the clamps 22 is prevented by the registration of the arm 24 with the undercuts 16 and protuberances 17. Movement to the front is prevented by an undercut surface 37 on each side of a corresponding arm 24 that registers against a rear of the flanges 15 of the housing 10 of the housing block 2.

We claim:

1. An electrical connector assembly for electrical conductors and a strain relief for the conductors, wherein the improvement comprises:

corresponding conductors project from opposite first and second sides of an insulative housing block of the connector assembly, conductive electrical terminals inside the housing block connected to corresponding conductors, duplicate first and second strain relief clamps latch to each other and clamp therebetween corresponding conductors to provide the strain relief, each of the clamps comprising a clamping surface elongated along a corresponding one of the sides of the housing block, a first arm projecting from a first end of the clamping surface, a projecting first pivot surface on the arm received in a recess in a corresponding end of the housing block for pivoting the clamping surface toward and against corresponding said conductors, a concave portion of the clamping surface adjacent the first arm, a convex portion of the clamping surface for deflecting corresponding conductors into the concave portion of the other said duplicate clamp, and a latch intersected by the convex portion wherein the clamping surface pivots about the first pivot surface about an axis normal to the plane of the corresponding side of the housing block.

2. A connector assembly and strain relief as recited in claim 1, wherein the improvement comprises:

the clamping surface extends from the first arm to the latch, perpendicular to the first arm.

3. A connector assembly and strain relief as recited in claim 1, wherein the improvement comprises:

a ridge of the clamp parallel to the clamping surface and engaged against the housing block.

4. A connector as recited in claim 1, wherein the improvement comprises:

a ridge along an edge of the clamp and engaged against the housing block.

5. A connector assembly and strain relief as recited in claim 1, wherein the improvement comprises:

the latch is on an end of the clamp and extends toward the other said clamp.

6. An electrical connector assembly for electrical conductors and a strain relief for the conductors, wherein the improvement comprises:

the connector assembly comprises an insulative housing block, and electrical contacts in the housing block connected to corresponding conductors, and bipartite parts of the strain relief pivot toward each other and clamp the cable therebetween and clamp opposite sides of the housing block therebetween, and latch means on the housing block and the strain relief interengage to allow pivoting of the bipartite parts on the housing block about an axis normal to the planes of the opposite sides of the housing block.

* * * * *

UNITED STATES PATENT OFFICE

CERTIFICATE OF CORRECTION

Patent No. 4,925,401 Dated May 15, 1990

Inventor(s) Michael W. Fogg, Et Al

It is certified that error appears in the above-identified patent and that said Letters Patent is hereby corrected as shown below:

IN THE ABSTRACT

An error in the abstract on line 11, "3" should be --4--.

Signed and Sealed this

Eleventh Day of February, 1992

*Attest:*

HARRY F. MANBECK, JR.

*Attesting Officer*

*Commissioner of Patents and Trademarks*